US009139338B2

(12) United States Patent
Wakatabi et al.

(10) Patent No.: US 9,139,338 B2
(45) **Date of Patent: *Sep. 22, 2015**

(54) ENVELOPE SHEET

(71) Applicant: RISO KAGAKU CORPORATION, Tokyo (JP)

(72) Inventors: Tadayuki Wakatabi, Ibaraki (JP); Akinori Maekawa, Ibaraki (JP)

(73) Assignee: Riso Kagaku Corporation, Tokyo (JP)

( * ) Notice: Subject to any disclaimer, the term of this patent is extended or adjusted under 35 U.S.C. 154(b) by 0 days.

This patent is subject to a terminal disclaimer.

(21) Appl. No.: 14/031,704

(22) Filed: Sep. 19, 2013

(65) Prior Publication Data

US 2014/0076960 A1 Mar. 20, 2014

(30) Foreign Application Priority Data

Sep. 20, 2012 (JP) ..... 2012-206744

(51) Int. Cl.

| | |
|---|---|
| ***B65D 27/00*** | (2006.01) |
| ***B65D 27/14*** | (2006.01) |
| ***B65B 25/14*** | (2006.01) |
| ***B65B 49/12*** | (2006.01) |
| ***B65B 51/02*** | (2006.01) |
| ***B65B 11/18*** | (2006.01) |

(52) U.S. Cl.

CPC ..... *B65D 27/14* (2013.01); *B65B 11/18* (2013.01); *B65B 25/14* (2013.01); *B65B 49/12* (2013.01); *B65B 51/02* (2013.01); *B65D 27/00* (2013.01)

(58) Field of Classification Search

CPC ..... B42D 15/08; B65D 27/00; B65D 27/16; B65D 27/14

USPC ..... 229/69, 75, 92.1–92.3, 80

See application file for complete search history.

(56) References Cited

U.S. PATENT DOCUMENTS

| | | | | |
|---|---|---|---|---|
| 217,155 | A * | 7/1879 | Rogers | 229/92.7 |
| 1,108,540 | A * | 8/1914 | Ahlquist | 229/80 |
| 3,523,638 | A * | 8/1970 | Moonan | 229/92.1 |
| 5,707,002 | A | 1/1998 | Miyamoto et al. | |
| 6,131,802 | A * | 10/2000 | Lombardo | 229/92.1 |
| 6,158,651 | A * | 12/2000 | Mehta et al. | 229/92.1 |
| 6,409,075 | B1 * | 6/2002 | Mehta et al. | 229/92.1 |
| 2013/0206824 | A1 * | 8/2013 | Wakatabi | 229/75 |

FOREIGN PATENT DOCUMENTS

| | | |
|---|---|---|
| JP | 2000-343892 | 12/2000 |
| JP | 2012240310 A * | 12/2012 |

* cited by examiner

*Primary Examiner* — Jes F Pascua

(74) *Attorney, Agent, or Firm* — Hamre, Schumann, Mueller & Larson, P.C.

(57) ABSTRACT

The envelope sheet includes a first area provided with a flap, a second area extended from the first area with interposing a first fold line, a third area extended from the second area with interposing a second fold line, and an adhesive pasted area formed on the third area and extended along a direction perpendicular to a feed direction. The envelope sheet is configured to be, in a stuff and seal apparatus, preliminarily folded at the second fold line while a content is stuffed thereinto, and then fed forward together with the content by at least two pairs of the feed rollers. A length of the third area along the feed direction is made equal-to or longer-than a distance between the two pairs of feed rollers. According to the envelope sheet, the content can be prevented from being inadequately stuffed into an envelope transformed from the envelope sheet.

8 Claims, 7 Drawing Sheets

ENVELOPE SHEET

BACKGROUND OF THE INVENTION

1. Technical Field

The present invention relates to an envelope sheet that is a foldable sheet to be transformed into an envelope.

2. Background Arts

Recently, developed are various types of envelope sheets to be used with an automated machine such as an envelope stuffer and an enveloping machine. A Japanese Patent Application Laid-Open No. 2000-343892 (Patent Document 1) discloses an envelope sheet.

The envelope sheet disclosed in the Patent Document 1 includes a rectangular first area, a rectangular second area extended from the first area along an envelope deployment direction (envelope feed direction) with interposing a first fold line, and a rectangular third area extended from the second area along the envelope deployment direction with interposing a second fold line. Namely, the three rectangular areas are aligned along the envelope deployment direction with interposing the two fold lines. Here, the first area is provided with a flap at its one end along the envelope deployment direction.

Although not explicitly disclosed in the Patent Document 1, an adhesive pasted area onto which the flap is to be sealed may be formed on the third area. The adhesive pasted area is extended perpendicular to the envelope deployment direction, and adhesive is pasted therewithin.

In an automated enveloping machine as mentioned above, printed papers are folded so as to be stuffed into envelopes as a content, and an envelope sheet as explained above is folded into an envelope while being fed by a pair of feed rollers. Subsequently, the folded printed sheets are stuffed into the envelope, and then the envelope is sealed.

SUMMARY OF THE INVENTION

However, the envelopes may be fed inadequately in the above enveloping machine, because the envelope sheet is folded into the envelopes into which the folded printed papers are stuffed is fed while being nipped by the pair of feed rollers.

In most of automated enveloping machines, one of the pair of feed rollers is served as a driving roller driven by a motor or the like, and another of the pair of the feed rollers is served as a driven roller passively rotated by the rotation of the driving roller. Therefore, when an envelope sheet preliminarily folded at the second fold line is fed along the envelope deployment direction with the second area headed forward and a length of the third area along the envelope deployment direction is short, only the envelope sheet contacting with the driving roller can be fed forward but the printed sheet contacting with the driven roller cannot be fed forward. As a result, the printed sheets folded as the content get misaligned with respect to the preliminarily folded envelope sheet.

An object of the present invention is to provide an envelope sheet that can prevent a content from being inadequately stuffed into an envelope to be transformed from the envelope sheet.

An aspect of the present invention provides an envelope sheet to be used in a stuff and seal apparatus, the envelope sheet comprising: a rectangular first area provided with a flap at one end thereof along an envelope feed direction; a rectangular second area extended from the first area along the envelope feed direction with interposing a first fold line; a rectangular third area extended from the second area along the envelope feed direction with interposing a second fold line; and an adhesive pasted area formed on the third area and extended along a direction perpendicular to the envelope feed direction to be adhered with the flap, wherein the envelope sheet is configured to be, in the stuff and seal apparatus, fed while the third area leads, preliminarily folded at the second fold line while a content is stuffed threreinto, and then fed forward together with the content stored therein by at least two pairs of the feed rollers, and a length of the third area along the envelope feed direction is made equal-to or longer-than a distance between the two pairs of feed rollers.

According to the above aspect, the length of the third area along the envelope feed direction is made equal-to or longer-than the distance between the two pairs of feed rollers, so that the content can be prevented from getting misaligned with respect to the preliminarily folded envelope sheet.

It is preferable that the adhesive pasted area is formed so that a length from an opposite edge of the third area to the second fold line to the adhesive pasted area along envelope feed direction is made equal-to or longer-than 20% of a width of the second area along the direction perpendicular to the envelope feed direction.

According to this configuration, the length from the edge of the third area to the adhesive pasted area can be made long enough, so that curl-ups and wavings of the envelope sheet can be prevented, and thereby sheet jams can be prevented.

It is preferable that a length of the first area along the envelope feed direction is made equal-to or longer than a length from an opposite edge of the third area to the second fold line to the adhesive pasted area along envelope feed direction.

According to this configuration, the flap can be adhered with the adhesive pasted area. In addition, a slack can be formed largely, so that a diameter of a feed roller can be made large. As a result, an envelope transformed from the envelope sheet can be fed stably.

DESCRIPTION OF THE EMBODIMENTS

Hereinafter, an embodiment will be explained with reference to the drawings. In following explanations, a content sheet(s) P1 and an envelope sheet(s) P2 are printed by an inkjet printer (image forming apparatus 3: see FIG. 2). However, they can be printed by other printing methods. A printing method is not limited.

Configurations of a stuff and seal system 1 in which the envelope sheet(s) P2 is used will be explained first. Note that, in the following explanations, terms "upstream" and "downstream" are used in relation to a feed flow of sheets (content sheets P1 and envelope sheets P2). In addition, terms "left" and "light" are used based on a state shown in FIG. 2.

Figure 1:
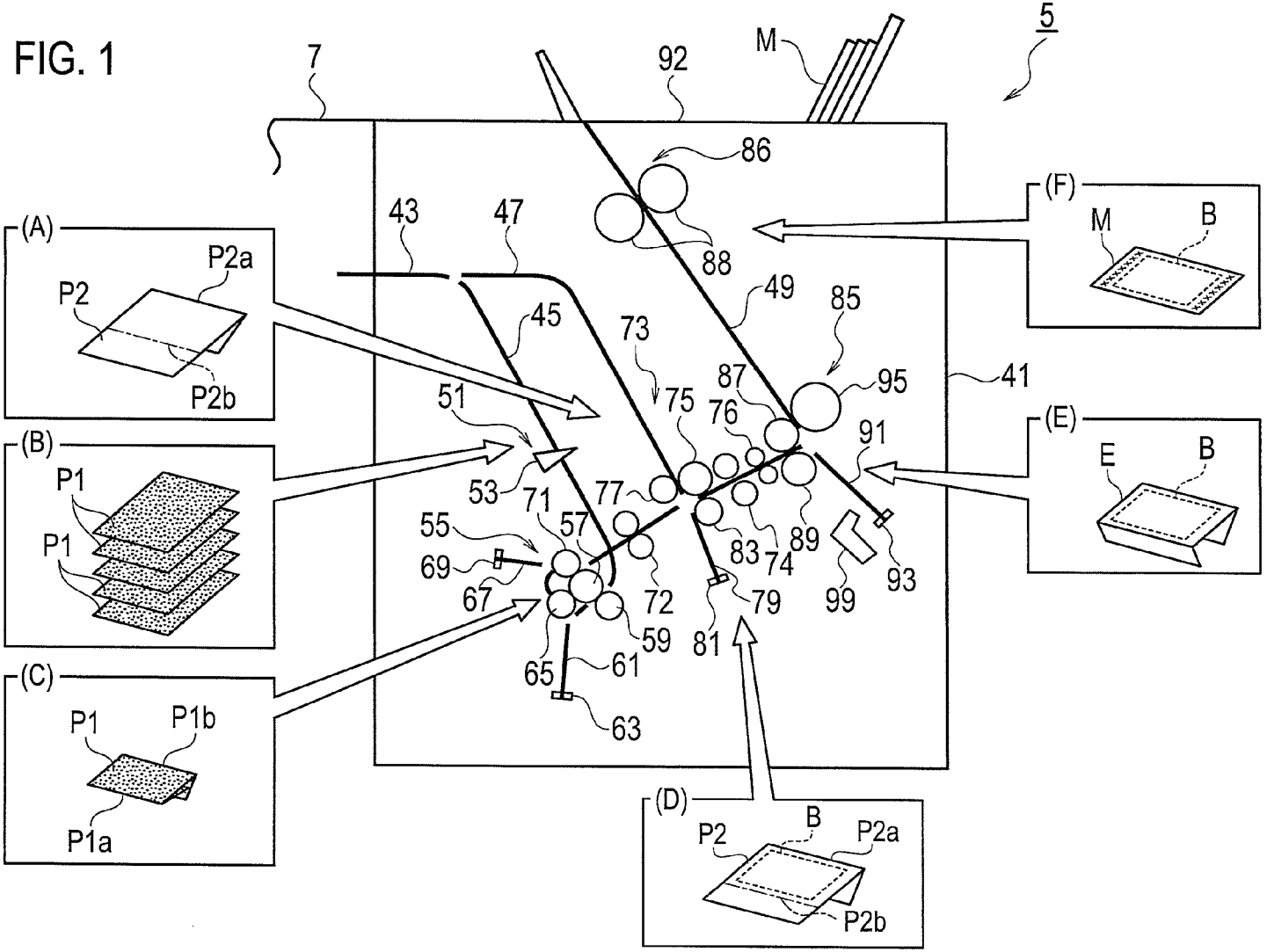
FIG. 1 is a schematic front view of an automated stuff and seal apparatus in which an envelope sheet(s) according to an embodiment is transformed into an envelope.
Figure 2:
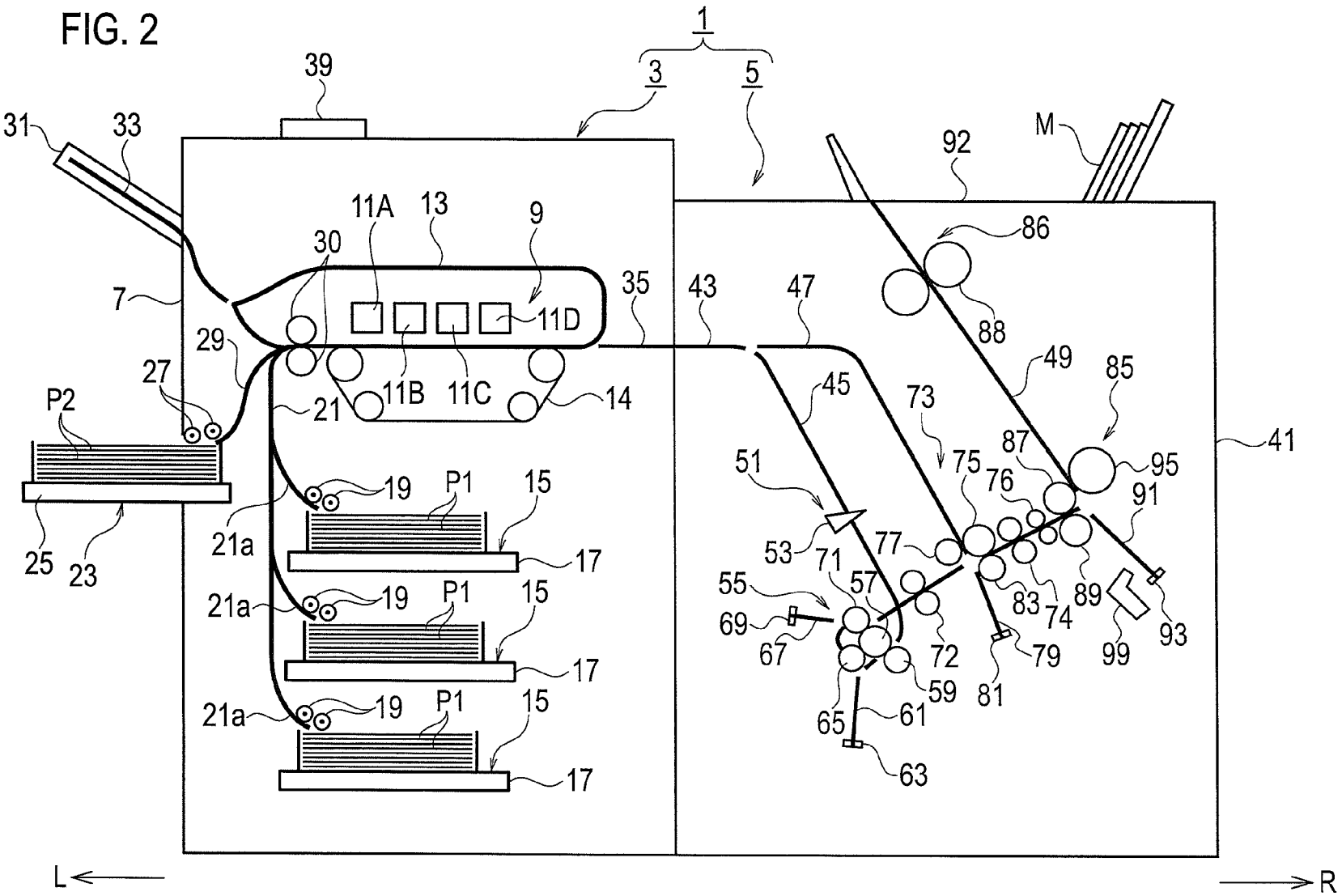
FIG. 2 is a schematic front view showing an automated stuff and seal system including the stuff and seal apparatus shown in FIG. 1 and an image forming apparatus.

As shown in FIGS. 1 and 2, the stuff and seal system 1 includes an image forming apparatus 3 and a stuff and seal apparatus 5. In the image forming apparatus 3, content sheets P1 and envelope sheets P2 are printed. In the stuff and seal apparatus 5, the content sheet(s) P1 is folded to be a content B for a letter M, and the envelope sheet P2 is also folded to be transformed into an envelopes E. In addition, in the stuff and seal apparatus 5, the content B is stuffed into the envelope E, and the envelope E that stores the content B is sealed to complete the letter M.

The image forming apparatus 3 includes a housing body 7. An inkjet-type print unit 9 is disposed in the housing body 7, and the print unit 9 prints the content sheets P1 and the envelope sheets P2 based on image data included in a print job(s) (content image data and envelope image data). The print unit 9 includes line-type ink heads 11A to 11D that inject color ink droplets (black, cyan, magenta, and yellow), respectively.

An endless platen belt 14 is disposed beneath the ink heads 11A to 11D. The content sheet P1 or the envelope sheet P2 is suctioned onto the platen belt 14 by a suction fan (not shown) provided inside the platen belt 14, and fed along a feed path to be printed by ink droplets injected from the ink heads 11A to 11D. A gap between the platen belt 14 and the ink heads 11A to 11D is set narrow to land ink droplets at adequate target positions on the sheet P1 or P2. Therefore, it is needed to avoid curl-ups and wavings of the sheets P1 and P2 fed by the platen belt 14 in order to prevent the sheets P1 and P2 from contacting with the ink heads 11A to 11D.

In addition, a print feed path 13 for feeding the sheets P1 and P2 are provided in the housing body 7 so as to surround the print unit 9. Plural pairs of first feed rollers (not shown) are disposed along the print feed path 13, and each of them feeds the sheets P1 and P2 forward by nipping them therebetween. The pairs of first feed rollers are driven by first feed motors (not shown).

Content sheet supply units 15 are vertically disposed under the print unit 9 in the housing body 7 in a multi-shelf manner, and the content sheets P1 are sequentially supplied from the content sheet supply units 15 toward the print unit 9 (the print feed path 13). Each of the content sheet supply units 15 includes a sheet supply tray 17 on which the content sheets P1 are stacked, and a pair of feed rollers 19 for feeding out the content sheets P1 sequentially toward the print unit 9. The pairs of feed rollers 19 are driven by content sheet supply motors (not shown).

In addition, a supply feed path 21 for feeding the content sheets P1 from the content sheet supply units 15 to the print unit 9 is vertically extended on a left side in the housing body 7. The supply feed path 21 includes three upstream ends (root ends) 21*a*, and the upstream ends 21*a* are extended back to the content sheet supply units 15, respectively. A downstream end (an upper end) of the supply feed path 21 is connected with the print feed path 13. Plural pairs of second feed rollers (not shown) are disposed along the supply feed path 21, and each of them feeds the content sheets P1 forward by nipping them therebetween. The pairs of second feed rollers are driven by second feed motors (not shown).

An envelope sheet supply unit 23 is provided on a left side of the housing body 7, and the envelope sheets P2 are sequentially supplied from the envelope sheet supply unit 23 toward the print unit 9 (the print feed path 13). The envelope sheet supply unit 23 includes a sheet supply tray 25 on which the envelope sheets P2 are stacked, and a pair of feed rollers 27 for feeding out the envelope sheets P2 sequentially toward the print unit 9. The pairs of feed rollers 27 are driven by envelope sheet supply motor (not shown).

In addition, a supply feed path 29 for feeding the envelope sheets P2 from the envelope sheet supply units 23 to the print unit 9 is disposed on the left side in the housing body 7. The supply feed path 29 includes an upstream end (root end), and the upstream ends 21*a* is extended back to the envelope sheet supply units 23. A downstream end (an upper end) of the supply feed path 29 is connected with the print feed path 13. Plural pairs of third feed rollers (not shown) are disposed along the supply feed path 29, and each of them feeds the envelope sheets P2 forward by nipping them therebetween. The pairs of third feed rollers are driven by third feed motors (not shown).

Note that the content sheets P1 may be set on the sheet supply tray 25, and the envelope sheets P2 may be set on the sheet supply tray 17.

A leading edge of the content sheet(s) P1 fed along the supply feed path 21 or the envelope sheet(s) P2 fed along the supply feed path 29 is contacted to a registration nip between a pair of registration rollers 30 to slack the sheet P1 or P2. By this contact to the registration nip, a position of the leading edge can be set precisely and an oblique feed of the sheet P1 or P2 can be compensated. Then, the registration rollers 30 are driven at an adequate timing to feed the sheet P1 or P2 to the print unit 9.

A cassette 31 for temporally storing the content sheet P1 or the envelope sheet P2 is provided on an upper left side of the print feed path 13. In addition, a switchback feed path 33 is extended from the left side in the housing body 7 to the inside of the cassette 31. A root end of the switchback feed path 33 can be connected-to and disconnected-from the print feed path 13 by a flapper (not shown) commonly used for switchback. Further, a pair of switchback rollers (not shown) for entering the sheet P1 or P2 into the cassette 31 and drawing the sheet P1 or P2 from the cassette 31 is provided on the left side in the housing body 7. The pair of switchback rollers can be driven forwardly and reversely by a switchback motor (not shown).

A feed-out path 35 is provided on a right side in the housing body 7. The feed-out path 35 feeds out the printed sheets P1 and P2 to the stuff and seal apparatus 5 from the image forming apparatus 3. An upstream end (a root end) of the feed-out path 35 can be connected-to and disconnected-from the print feed path 13 by a flapper (not shown) commonly used. In addition, plural pairs of fourth feed rollers (not shown) are disposed along the feed-out path 35, and each of them feeds the printed sheets P1 and P2 forward by nipping them therebetween. The pairs of fourth feed rollers are driven by fourth feed motors (not shown).

As shown in FIGS. 1 and 2, the stuff and seal apparatus 5 in the stuff and seal system 1 includes a housing body 41. A feed-in path 43 is provided on a left side in the housing body 41. The feed-in path 43 sequentially receives the printed sheets P1 and P2 from the feed-out path 35 (the image forming apparatus 3), and then feed them forward. An upstream end (a root end) of the feed-in path 43 is connected with a downstream end (terminal end) of the feed-out path 35. In addition, plural pairs of fifth feed rollers (not shown) are disposed along the feed-in path 43, and each of them feeds the printed sheets P1 and P2 forward by nipping them therebetween. The pairs of fifth feed rollers are driven by fifth feed motors (not shown).

A content sheet feed path 45 for feeding the printed content sheets P1 (incl. the contents B) is provided in the housing body 41. An upstream end (a root end) of the content sheet feed path 45 can be connected-to and disconnected-from the downstream end (terminal end) of the feed-in path 43 by a flapper (not shown) commonly used. In addition, plural pairs of sixth feed rollers (not shown) are disposed along the content sheet feed path 45, and each of them feeds the printed content sheets P1 forward by nipping them therebetween. The pairs of sixth feed rollers are driven by sixth feed motors (not shown).

An envelope sheet feed path 47 for feeding the printed envelope sheets P2 is provided above the content sheet feed path 45 in the housing body 41. An upstream end (a root end) of the envelope sheet feed path 47 can be connected-to and disconnected-from the downstream end (terminal end) of the feed-in path 43 by the flapper (not shown) commonly used. In addition, plural pairs of seventh feed rollers (not shown) are disposed along the envelope sheet feed path 47, and each of them feeds the printed envelope sheets P2 forward by nipping them therebetween. The pairs of seventh feed rollers are driven by seventh feed motors (not shown).

The downstream end of the content sheet feed path 45 and the downstream end of the envelope sheet feed path 47 are made confluent. An envelope feed path 49 is provided on a downstream side (an exit side) of the confluence of the paths 45 and 47 in the housing body 41. The envelope feed path 49 feeds the envelopes E (incl. the letters M) in each of which the content B is stored. The envelope feed path 49 is extended upward to an upper end of the housing body 41. In addition, plural pairs of eighth feed rollers (not shown) are disposed along the envelope feed path 49, and each of them feeds the envelope E forward by nipping them therebetween. The pairs of eighth feed rollers are driven by eighth feed motors (not shown).

A set-up part 51 is provided in the middle of the content sheet feed path 45. In the set-up part 51, the printed content sheets P1 (may have different contents, respectively) are stacked in an adequate order (see (B) in FIG. 1). In addition, the set-up part 51 includes a set-up gate (waiting gate) 53 on which the printed content sheets P1 are waited. The set-up gate 53 can open/block the content sheet feed path 45.

A content sheet folding part 55 is provided on an exit side (downstream side) of the set-up part 51 along the content sheet feed path 45. In the content sheet folding part 55, the stacked content sheets P1 fed from the set-up part 51 is folded to be the content B (see (C) in FIG. 1). Specific configurations of the content sheet folding part 55 will be explained hereinafter. Note that it is possible that only one content sheet P1 is folded as one content B by the content sheet folding part 55.

A primary folding roller 57 is rotatably provided on the exit side (downstream side) of the set-up part 51 in the housing body 41. A feed-in roller 59 is rotatably provided in a contacted manner with the primary folding roller 57 on a lower-right side of the primary folding roller 57 in the housing body 41. The primary folding roller 57 and the feed-in roller 59 receive the stacked content sheets P1 from the set-up part 51 in cooperation with each other.

In addition, a guide plate 61 is provided beneath the primary folding roller 57 in the housing body 41. The guide plate 61 guides the stacked content sheets P1 received and fed forward by the primary folding roller 57 and the feed-in roller 59. Further, the guide plate 61 includes an end block 63. Leading edges of the stacked content sheets P1 are contacted with the end block 63 to form a slack at fold lines P1*a*. The end block 63 can be shifted along the guide plate 61 by a first shifting motor (not shown).

Furthermore, an intermediate roller 65 is rotatably provided in a contacted manner with the primary folding roller 57 on a lower-left side of the primary folding roller 57 in the housing body 41. The primary folding roller 57 and the intermediate roller 65 fold the stacked content sheets P1 slacked at the fold lines P1*a* in cooperation with each other.

A guide plate 67 is provided on a left side of the primary folding roller 57 in the housing body 41. The guide plate 67 guides the stacked content sheets P1 folded by the primary folding roller 57 and the intermediate roller 65. In addition, the guide plate 67 includes an end block 69. Leading edges (opposite edges to the edges contacted to the end block 63) of the folded content sheets P1 are contact with the end block 69 to form a slack at fold lines P1*b*. The end block 69 can be shifted along the guide plate 67 by a second shifting motor (not shown).

Further, a feed-out roller 71 is rotatably provided in a contacted manner with the primary folding roller 57 on an opposite side to the feed-in roller 59 in the housing body 41. The primary folding roller 57 and the feed-out roller 71 fold the stacked content sheets P1 slacked at the fold lines P1*b* in cooperation with each other, and then feed them forward as the content B. Here, the primary folding roller 57, the feed-in roller 59, the intermediate roller 65, and the feed-out roller 71 are driven by a first folding motor (not shown).

A pre-folding part 73 is provided at a confluence of the content sheet feed path 45 and the envelope sheet feed path 47. The pre-folding part 73 preliminarily folds the printed envelope sheet P2 fed from the feed-out path 35 (see (A) in FIG. 1). Specific configurations of the pre-folding part 73 will be explained hereinafter.

A primary folding roller 75 is rotatably provided at the confluence of the content sheet feed path 45 and the envelope sheet feed path 47. A feed-in roller 77 is rotatably provided in a contacted manner with the primary folding roller 75 on a left side of the primary folding roller 75 in the housing body 41. The primary folding roller 75 and the feed-in roller 77 receive the printed envelope sheets P2 fed along envelope sheet feed path 47 in cooperation with each other.

A guide plate 79 is provided beneath the primary folding roller 75 in the housing body 41. The guide plate 79 guides the printed envelope sheet P2 fed by the primary folding roller 75 and the feed-in roller 77. Further, the guide plate 79 includes an end block 81. A leading edge of the printed envelope sheet P2 is contacted with the end block 81 to form a slack at a fold line P2*a* (a second fold line 115 explained later). The end block 81 can be shifted along the guide plate 79 by a third shifting motor (not shown).

Further, a feed-out roller 83 is rotatably provided in a contacted manner with the primary folding roller 75 on a lower-right side of the primary folding roller 75 in the housing body 41. The primary folding roller 75 and the feed-out roller 83 fold the printed envelope sheet P2 slacked at the fold line P2*a* in cooperation with each other and stuff the content B fed by a pair of feed roller 72 into the pre-folded envelope sheet P2 (see (D) in FIG. 1), and then feed them (the pre-folded envelope sheet P2 and the content B) toward an envelope forming part 85. Here, the primary folding roller 75, the feed-in roller 77, and the feed-out roller 83 are driven by a second folding motor (not shown).

A pair of feed rollers 74 and a pair of feed rollers 76 are provided on a downstream side of the pre-folding part 73. The pairs of feed rollers 74 and 76 feed the pre-folded envelope sheet P2 that stores the content B toward the envelope forming part 85. One of the pair of feed rollers 74 is served as a driving roller driven by a drive motor (not shown), and another of the pair of the feed rollers 74 is served as a driven motor passively rotated by the rotation of the driving roller. Similarly, one of the pair of feed rollers 76 is served as a driving roller driven by a drive motor (not shown), and another of the pair of the feed rollers 76 is served as a driven motor passively rotated by the rotation of the driving roller.

As mentioned above, the envelope forming part 85 is provided on the downstream side of the pre-folding part 73. The envelope forming part 85 folds the pre-folded envelope sheet P2 that stores the content B to form the envelope E (see (E) in FIG. 1). Specific configurations of the envelope forming part 85 will be explained hereinafter.

A primary folding roller 87 is rotatably provided at an exit side (the downstream side) of the pre-folding part 73 in the housing body 41. A feed-in roller 89 is rotatably provided in a contacted manner with the primary folding roller 87 on a lower-right side of the primary folding roller 87 in the housing body 41. The primary folding roller 87 and the feed-in roller 89 receive the pre-folded envelope sheets P2 fed along envelope sheet feed path 47 in cooperation with each other.

A guide plate 91 is provided on the lower-right side of the primary folding roller 87 (on a right side of the feed-in roller 89) in the housing body 41. The guide plate 91 guides the pre-folded envelope sheet P2 fed by the primary folding roller 87 and the feed-in roller 89. Further, the guide plate 91 includes an end block 93. A leading edge (the fold line P2*a*) of the pre-folded envelope sheet P2 is contacted with the end block 93 to form a slack at a fold line P2*b* (a first fold line 111 explained later). The end block 93 can be shifted along the guide plate 91 by a fourth shifting motor (not shown).

A wetting unit 99 for wetting an adhesive pasted area 123 (explained later) on the envelope sheet P2 is provided along the guide plate 91 and near the end block 93. A final folding roller 95 is rotatably provided in a contacted manner with the primary folding roller 87 on an upper-right side of the primary folding roller 87 in the housing body 41. The primary folding roller 87 and the final folding roller 95 fold the pre-folded envelope sheet P2 at the fold line P2*b* in cooperation with each other to form the envelope E.

A sealing part 86 is provided in the middle of the envelope feed path 49. The sealing part 86 seals the envelope E fed from the envelope forming part 85. In addition, the sealing part 86 includes a pair of seal rollers 88 that nips and feeds the envelope E to complete the letter M (see (F) in FIG. 1). The pair of seal rollers 88 is driven by a seal motors (not shown). Here, the envelope E is sealed by a pressure sensitive adhesive preliminarily pasted in adhesive pasted area 119 and 121 on the envelope sheet P2.

Further, a letter ejection part 92 is provided on a downstream side of the envelope feed path 49. The letters M sealed appropriately is ejected from the envelope feed path 49 to the letter ejection part 92.

Figure 3:
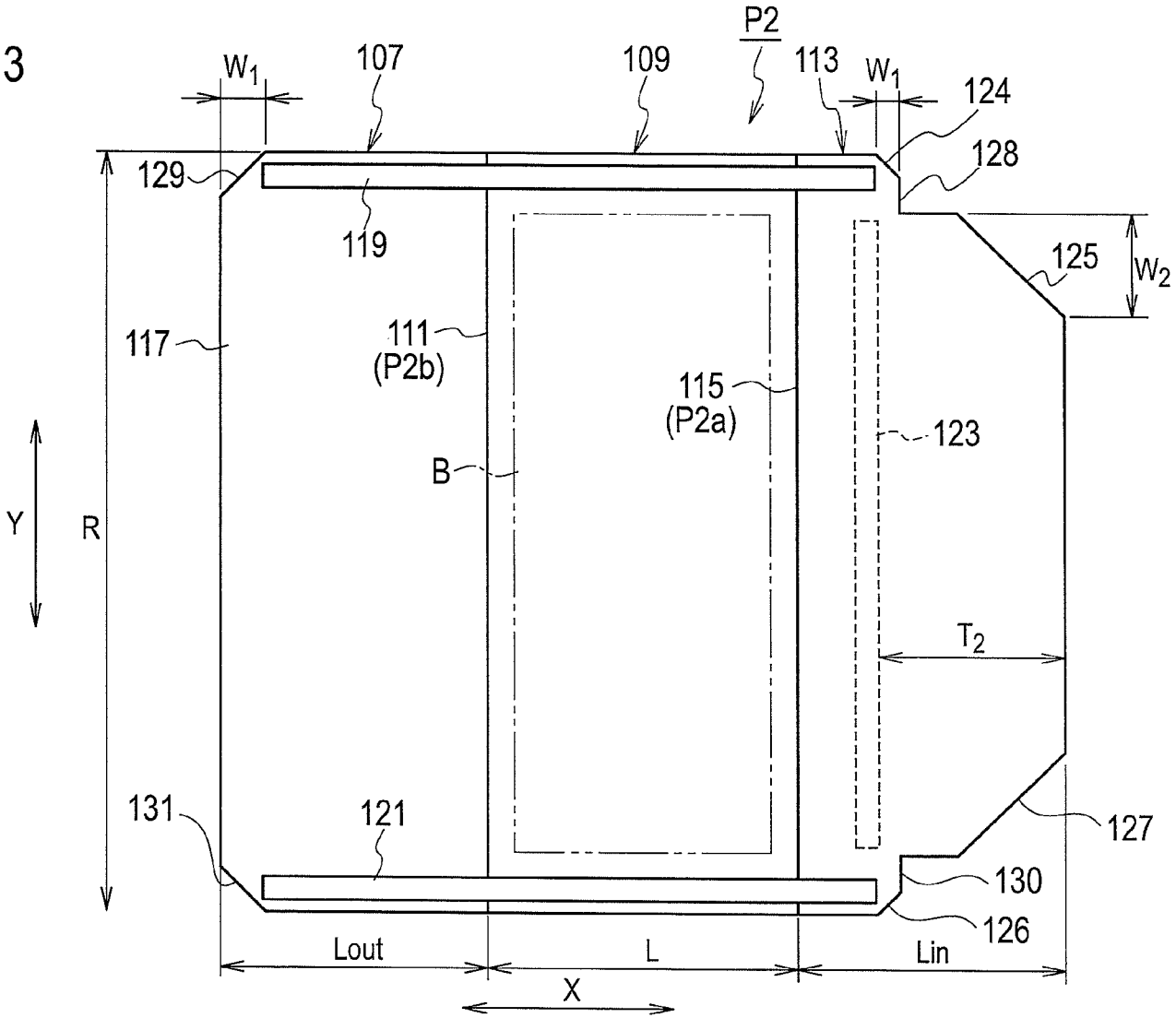
FIG. 3 is a plan view showing the envelope sheet.
Figure 4A:
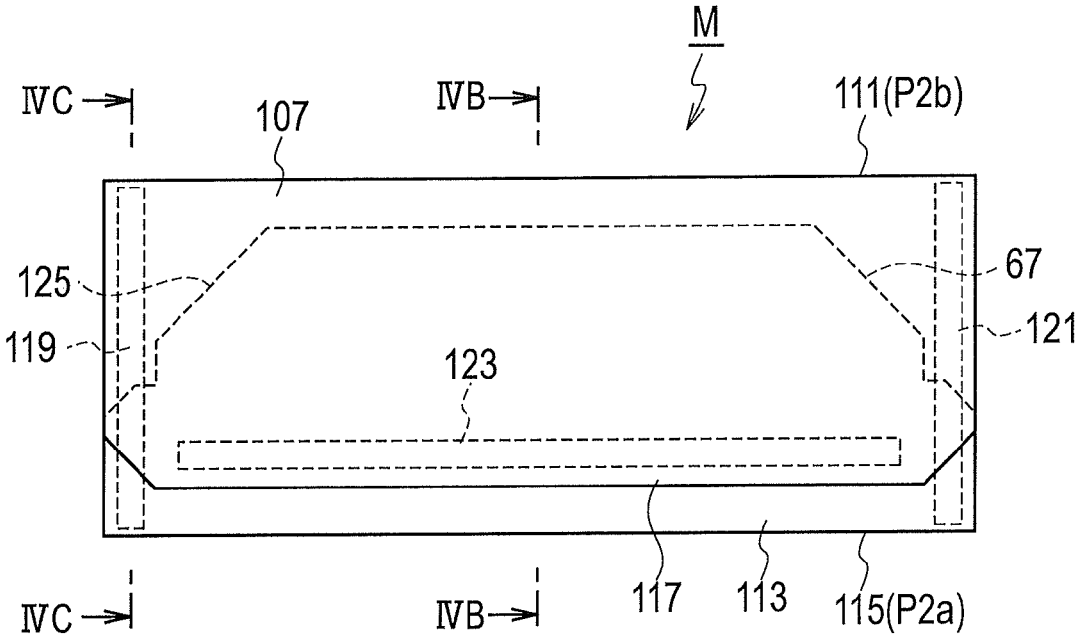
FIG. 4A is a plan view showing the envelope transformed from the envelope sheet.
Figure 4B:
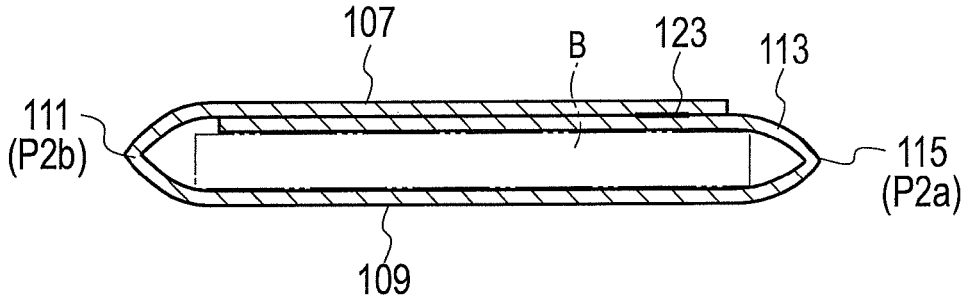
FIG. 4B is a cross-sectional view taken along a line IVB-IVB shown in FIG. 4A.
Figure 4C:
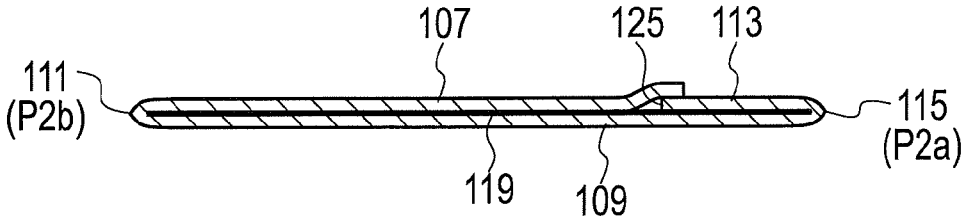
FIG. 4C is a cross-sectional view taken along a line IVC-IVC shown in FIG. 4A.

The envelope sheet P2 according to the present embodiment will be explained with reference to FIGS. 3 to 4C. As explained above, the envelope sheet P2 is used for making the letter M that stores the content B by the stuff and seal system 1. The envelope sheet P2 includes a rectangular first area 107, a rectangular second area 109 extended from the first area 107 along the envelope deployment direction (envelope feed direction) X with interposing the first fold line 111 (the above-mentioned fold line P2*b*), and a rectangular third area 113 extended from the second area 109 along the envelope deployment direction X with interposing the second fold line 115 (the above-mentioned fold line P2*a*). Namely, the three rectangular areas 107, 109 and 113 are aligned along the envelope deployment direction X with interposing the two fold lines 111 and 115.

Here, a length L of the second area 109 along the envelope deployment direction X is made longer than a length Lout of the first area 107 along the envelope deployment direction X. In addition, the length Lout of the first area 107 along the envelope deployment direction X is made equal-to or longer-than a length $T_2$ from an opposite edge of the third area 113 to the second fold line 115 (an open edge of the third area 113) to the adhesive pasted area 123 explained later on the third area 113 along the envelope deployment direction X.

Further, the second area 109 and the third area 113 are configured to store the content B therebetween. A length Lin of the third area 113 along the envelope deployment direction X is made equal-to or longer-than ¾ (three-fourth) of the length L of the second area 109 along the envelope deployment direction X, and made shorter than the length L.

The first area 107 is provided with a flap 117 at its one end along the envelope deployment direction X. Texts, images and so on are printed on outside and inside faces of the areas 107, 109 and 113 by the print unit 9. The third area 113 is folded along the second fold line 115 by the pre-folding part 73 and the first area 107 is folded along the first fold line 111 by the envelope forming part 85. Grain of the areas 107, 109 and 113 (the envelope sheet P2) is extended along a direction Y perpendicular to the envelope deployment direction X.

The adhesive pasted areas 119 and 121 within each of which a pressure sensitive adhesive is pasted are continuously formed on both sides of the areas 107, 109 and 113 along the envelope deployment direction X, respectively. Note that the adhesive pasted areas 119 and 121 may not be continuously formed but divided into plural segments along the envelope deployment direction X.

The adhesive pasted area 123 is formed on an outer face of the third area 113 at an area to be contacted with the flap 117 when the first area 107 is to be folded onto the pre-folded third area 113. A water-activated adhesive (one type of adhesives) is pasted in the adhesive pasted area 123. The adhesive pasted area 123 is extended along the direction Y. The adhesive pasted area 123 is formed between the adhesive pasted areas 119 and 121 on both sides.

The adhesive pasted area 123 is formed so that the above-mentioned length $T_2$ is made equal-to or longer-than 20% of a width R of the second area 109 along the direction Y. Here, the adhesive is wet by the wetting unit 99 while the envelope sheet P2 is folded by the envelope forming part 85, and thereby its water-activated adhesive force can be exerted by a pressure force smaller than that required for a pressure sensitive adhesive.

Orthogonal cutouts 128 and 130 are formed near ends of the adhesive pasted areas 119 and 121 on the third area 113, respectively. Namely, each of the cutouts 128 and 130 is provided with an edge parallel to rotational axes of the feed rollers. Therefore, the envelope sheet P2 can be easily nipped from the cutouts 128 and 130 by the pair of feed rollers 27 of the envelope sheet supply unit 23, and the primary folding roller 75 and the feed-in roller 77 of the pre-folding part 73.

Truncated corners 124 and 126 are formed outside the cutouts 128 and 130 on the third area 113, respectively. Each width $W_1$ of the truncated corners 124 and 126 along the envelope deployment direction X is set so that the envelope sheet P2 can contact with sheet fences 18 in the sheet supply tray 17 to be aligned adequately at its adequate location.

Figure 5:
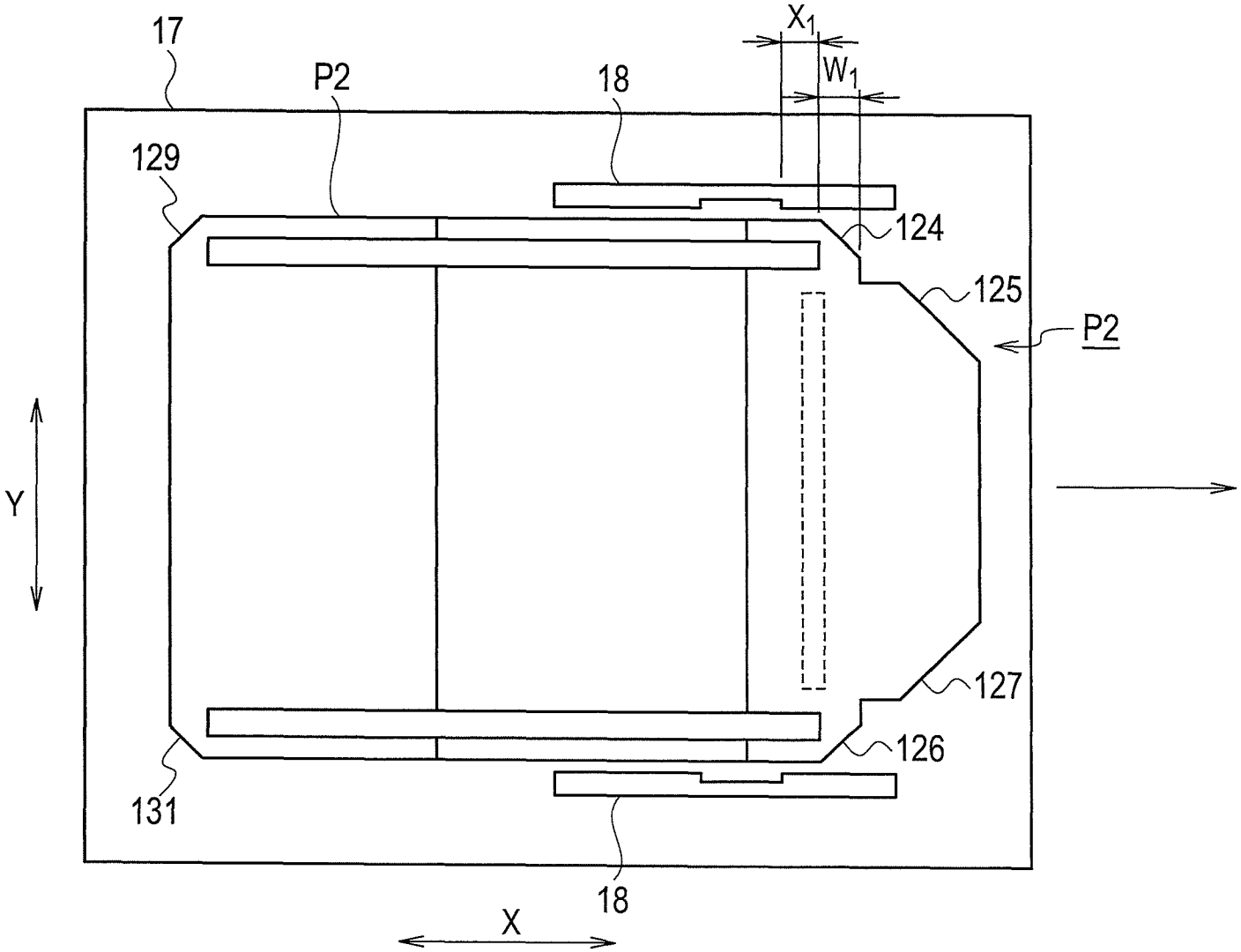
FIG. 5 is a plan view showing a state where the envelope sheet is laid on a sheet supply tray.

As shown in FIG. 5, the sheet supply tray 17 is provided with the sheet fences 18 extending along the envelope deployment direction (envelope feed direction) X. The sheet fences 18 guide the envelope sheets P2 so that the envelope sheets P2 are sequentially fed out smoothly from the sheet supply tray 17.

As explained above, the truncated corners 124 and 126 (each width of them is set to $W_1$) are formed to contact with the sheet fences 18, so that the envelope sheet P2 can be aligned adequately at its adequate location on the sheet supply tray 17. Similarly to the truncated corners 124 and 126, truncated corners 129 and 131 are formed on both sides of the trailing edge of the envelope sheet P2.

Since the truncated corners 124 and 126 are formed on both sides of the third area 113 (the truncated corners 129 and 131 are formed on both sides of the first area 107), the envelope sheet P2 can be smoothly suctioned onto the platen belt 14 by the suction fan provided inside the platen belt 14, and curl-ups and wavings of the corners of the envelope sheet P2 can be prevented. As a result, sheet jams can be prevented. In addition, since the truncated corners 124 and 126 are formed on both sides of the third area 113, the envelope sheets P2 can be guided by the sheet fences 18 and then smoothly fed out sequentially from the sheet supply tray 17 along the envelope deployment direction (envelope feed direction) X.

Figure 6:
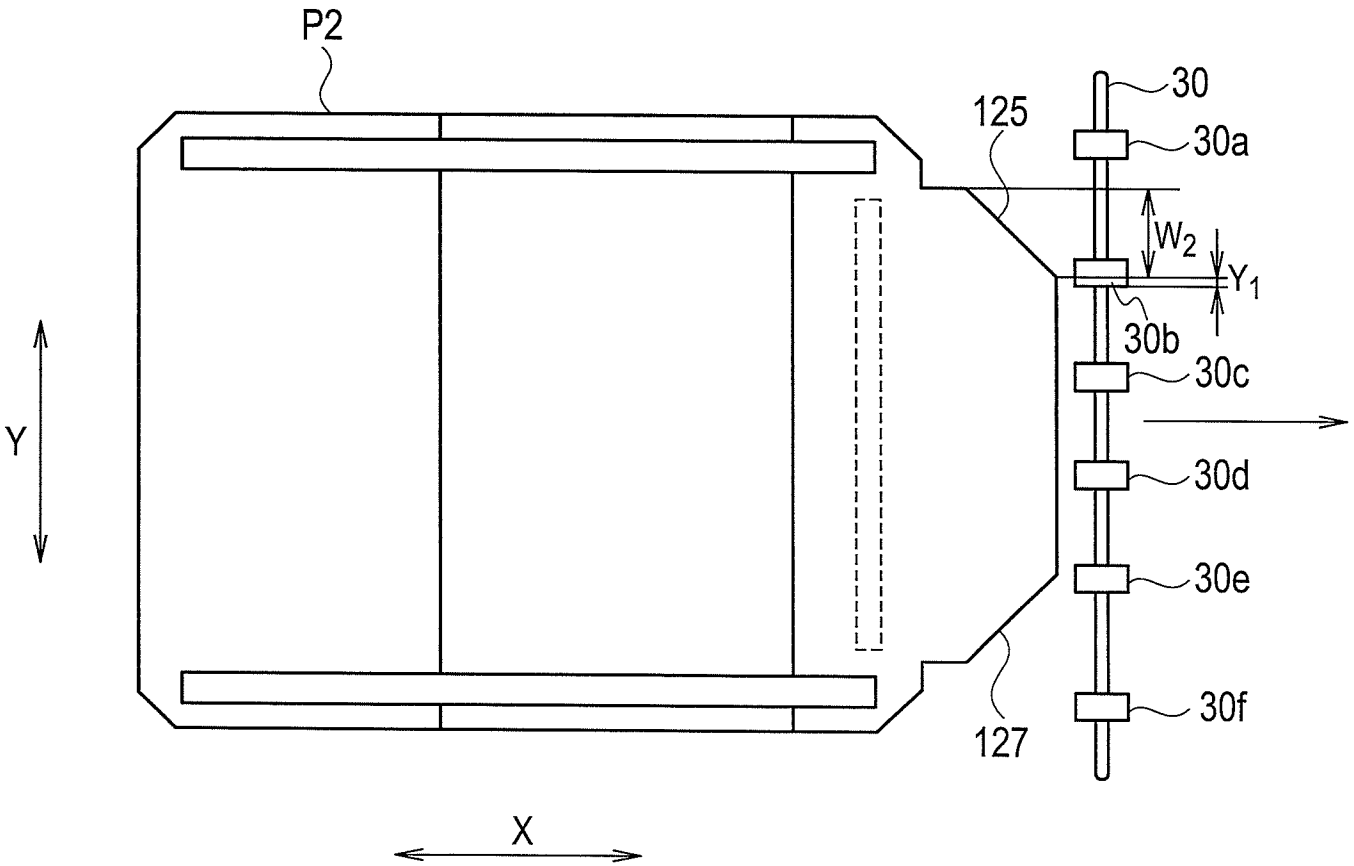
FIG. 6 is a plan view showing a state where the envelope sheet is fed out from the sheet supply tray.

As shown in FIG. 6, the envelope sheet P2 fed out from the sheet supply tray 17 along the envelope deployment direction (envelope feed direction) X is contacted the registration nip between the pair of registration rollers 30 to slack the envelope sheet P2. By this contact to the registration nip, a position of the leading edge can be set precisely and an oblique feed of the envelope sheet P2 can be compensated. Then, the registration rollers 30 are driven at an adequate timing to feed the sheet P1 or P2 to the print unit 9 with no oblique feed.

Each of the registration rollers 30 includes rollers 30*a* to 30*f* fixed to its rotational shaft at intervals along the direction Y. It depends on the size of the envelope sheet P2 (the content sheet P1) which of the rollers 30*a* to 30*f* contact with the leading edge of the envelope sheet P2. For example, when the size of the envelope sheet P2 is A3, the leading edge of the envelope sheet P2 contacts with all the rollers 30*a* to 30*f*. When the size of the envelope sheet P2 is A4, the leading edge of the envelope sheet P2 contacts with the rollers 30*b* to 30*e*. When the size of the envelope sheet P2 is "post card", the leading edge of the envelope sheet P2 contacts with the rollers 30*c* and 30*d*.

In order to contact the leading edge of the envelope sheet P2 (A4) with the rollers 30*b* to 30*e* for the compensation of an oblique feed, truncated corners 125 and 127 are formed at both ends of the leading edge of the envelope sheet P2. Specifically, the leading edge of the envelope sheet P2 contacts with the rollers 30*b* and 30*e* at portions $Y_1$ shown in FIG. 6 (only one of the portions $Y_1$ is indicated in FIG. 6). Namely, widths $W_2$ of the truncated corners 125 and 127 along the direction Y are set so as to contact the leading edge of the envelope sheet P2 with rollers 30*b* and 30*e* at the portions $Y_1$.

Since the truncated corners 125 and 127 are formed on both sides of the third area 113 (the leading edge of the envelope sheet P2), the envelope sheet P2 can be smoothly suctioned onto the platen belt 14 by the suction fan provided inside the platen belt 14, and curl-ups and wavings of the corners of the envelope sheet P2 can be prevented. As a result, sheet jams can be prevented.

In addition, since the truncated corners 125 and 127 are formed so as to contact the leading edge of the envelope sheet with the rollers 30*b* to 30*e* at the registration nip between the pair of registration rollers 30, the envelope sheet P2 is slacked due to contacting with the registration nip and thereby a position of the leading edge can be set precisely and an oblique feed of the envelope sheet P2 can be compensated. Then, the registration rollers 30 are driven at an adequate timing to feed the envelope sheet P2 to the print unit 9 with no oblique feed.

Figure 7:
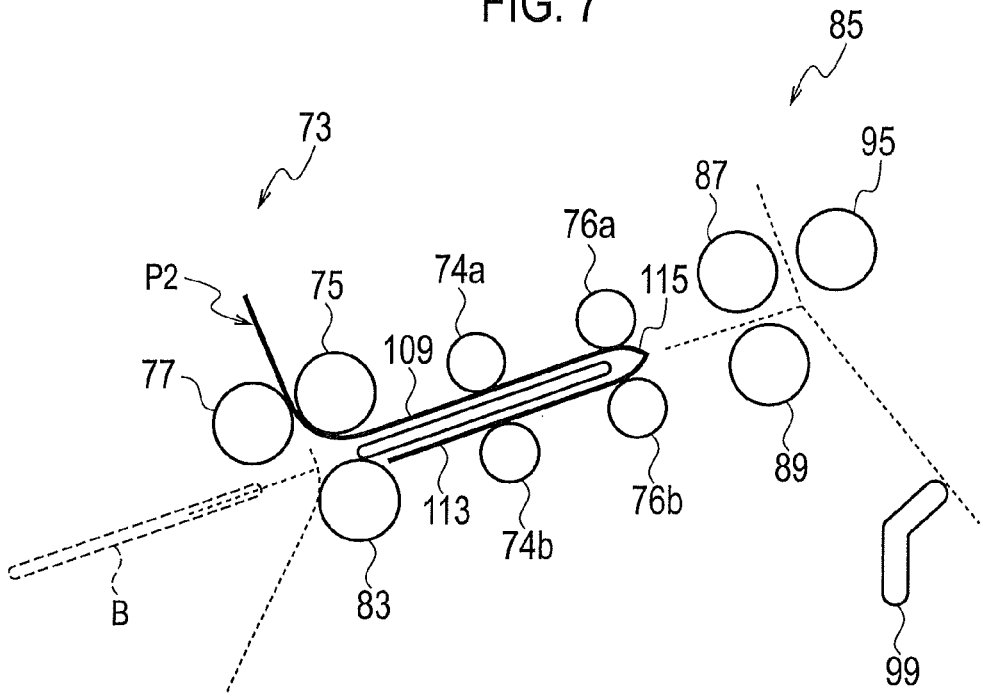
FIG. 7 is a side view showing a state where the envelope sheet is being fed.
Figure 8:
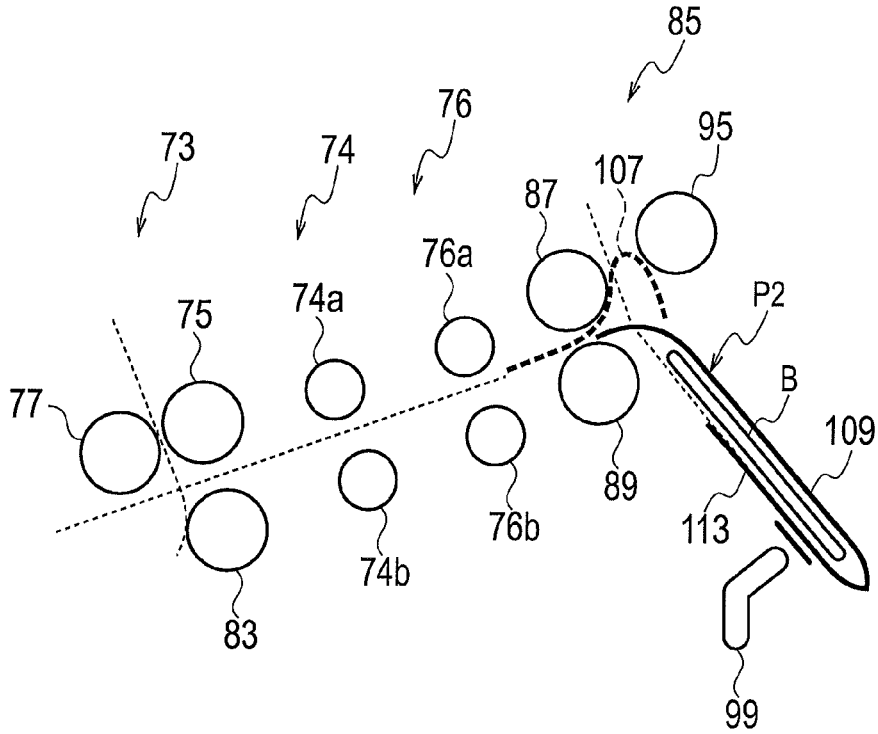
FIG. 8 is a side view showing another state where the envelope sheet is being fed.

Next, advantages of the envelope sheet P2 will be explained with reference to FIGS. 7 and 8. As shown in FIG. 7, the pre-folding part 73 preliminarily folds the envelope sheet P2 fed through the feed-out path 35 and the envelope sheet feed path 47. Specifically, the primary folding roller 75 and the feed-out roller 83 preliminarily fold the printed envelope sheets P2 slacked at the second fold lines 115 in cooperation with each other, and stuff the content B fed from the content sheet folding part 55 into the pre-folded envelope sheet P2, and then feed them (the pre-folded envelope sheet P2 and the content B) toward the envelope forming part 85.

Then the pre-folded envelope sheet P2 and the content B stored therein are further fed to the envelope forming part 85 by the pair of feed rollers 74 and the pair of feed rollers 76. As explained above, one roller 74*a* of the pair of feed rollers 74 is served as a driving roller driven by the drive motor (not shown), and another roller 74*b* is served as a driven motor passively rotated by the rotation of the driving roller 74*a*. Similarly, one roller 76*a* of the pair of feed rollers 76 is served as a driving roller driven by the drive motor (not shown), and another roller 76*b* is served as a driven motor passively rotated by the rotation of the driving roller 76*a*.

In the envelope sheet P2 according to the present embodiment, the length Lin of the third area 113 along the envelope deployment direction X is made equal-to or longer-than ¾ (three-fourth) of the length L of the second area 109 along the envelope deployment direction X, as explained above. Therefore, the driven rollers 74*b* and 76*b* are rotated while contacting with the third area 113 to feed the pre-folded envelope sheet P2 and the content B stored therein as a single element. Since it is not needed to drive the driven rollers 74*b* and 76*b*, the configurations of the stuff and seal system 1 (stuff and seal apparatus 5) can be simplified.

If the length Lin is made shorter than ¾ (three-fourth) of the length L, the driven roller 74*b* contacts with the content B before the leading edge (the second fold line 115) reaches the pair of feed rollers 76. In this case, the driving roller 74*a* rotates while contacting with the pre-folded envelope sheet P2, and the driven roller 74*b* is not rotated while contacting with the content B. As a result, only the pre-folded envelope sheet P2 is fed forward, and the content B is left behind.

Since the length Lin is made equal-to or longer-than ¾ (three-fourth) of the length L in the envelope sheet P2 according to the present embodiment, the driven rollers 74*b* and 76*b* feed the pre-folded envelope sheet P2 (in which the content B is stored) forward in cooperation with each other while contacting with the third area 113. Therefore, the content B is not left behind, but fed forward while being stored in the pre-folded envelope sheet P2. In addition, the content B can be also prevented from getting misaligned with respect to the pre-folded envelope sheet P2.

Although the length Lin is made equal-to or longer-than ¾ (three-fourth) of the length L in the envelope sheet P2 according to the present embodiment, the length Lin of the third area 113 should be determined based on positions of the feed rollers. Specifically, the length Lin should be longer than a distance between the pair of the feed rollers 74 and the pair of the feed rollers 76. When the length Lin is made longer than the above distance, the driven rollers 74*b* and 76*b* can feed the pre-folded envelope sheet P2 (in which the content B is stored) forward in cooperation with each other. Therefore, the content B can be prevented from being left behind and from getting misaligned with respect to the pre-folded envelope sheet P2.

In the envelope sheet P2 according to the present embodiment, the length Lin is made equal-to or longer-than the distance between the pair of the feed rollers 74 and the pair of the feed rollers 76 (the distance is ¾ of the length L in the present embodiment). Therefore, the above-explained length $T_2$ can be made long enough. If the length $T_2$ is long, an open end of the third area 113 may curl but an area suctioned onto the platen belt 14 (an applied suction force per unit width) becomes large. Therefore, the curl-up can be flattened by the large force. If the is short, an open end of the third area 113 may hardly curl but an area suctioned onto the platen belt 14 (an applied suction force per unit width) becomes small. Therefore, it is hard to flatten the curl-up by the small force. As a result, the envelope sheet P2 (the third area 113) may contact with the ink heads. By the envelope sheet P2 according to the present embodiment, the length $T_2$ can be made long enough, so that curl-ups and wavings of the envelope sheet can be prevented and thereby sheet jams can be prevented.

In the envelope sheet P2 according to the present embodiment, the length Lout of the first area 107 along the envelope deployment direction X is made equal-to or longer-than the above-explained length $T_2$. Therefore, a diameter of the final folding roller 95 can be made large enough. By making the diameter of the final folding roller 95 large enough, a slack can be made largely at the first fold line 111 on the pre-folded envelope sheet P2 (see FIG. 8). As a result, the envelope E can be fed forward stably.

In addition, if the length Lout is made equal-to or longer-than the above-explained length $T_2$, the wetting unit 99 can be located at a position distanced from the primary folding roller 87, the feed-in roller 89 and the final folding roller 95. Therefore, water droplets from the wetting unit 99 can be prevented from attaching to the rollers 87, 89 and 95. As a result, it becomes possible to form the envelope E without making it dirty.

The present invention is not limited to the above-mentioned embodiment, and it is possible to embody the present invention by modifying its components in a range that does not depart from the scope thereof. Further, it is possible to form various kinds of inventions by appropriately combining a plurality of components disclosed in the above-mentioned embodiment. For example, it may be possible to omit several components from all of the components shown in the above-mentioned embodiment.

The present application claims the benefit of a priority under 35 U.S.C §119 to Japanese Patent Application No. 2012-206744, filed on Sep. 20, 2012, the entire content of which is incorporated herein by reference.

What is claimed is:

1. An envelope sheet to be used in a stuff and seal apparatus, the envelope sheet comprising:

a rectangular first area provided with a flap at a first end thereof in a longitudinal direction;

a rectangular second area extended from the first area in the longitudinal direction and connected to the first area along a first fold line;

a substantially rectangular third area extended from the second area in the longitudinal direction and connected to the second area along a second fold line, the second fold line being parallel to the first fold line;

a first adhesive pasted area formed on the third area to be adhered with the flap, the first adhesive pasted area extending in a direction that is parallel to the first fold line, and a pair of second adhesive pasted areas, each second adhesive pasted area extending in the longitudinal direction and formed in the first area, the second area and the third area, a pair of cutouts formed in the third area so as to form a shortened portion along an end of the third area, a width of the shortened portion being less than a width of the flap in a first direction orthogonal to the longitudinal direction, a width of the first adhesive pasted area is equal to or less than the width of the shortened portion in the first direction, and in a folded state, the third area is folded between the first and second areas, wherein each of the second adhesive pasted areas overlap with the first adhesive pasted area in the longitudinal direction in the third area, and the first and second adhesive pasted areas are not formed on the shortened portion of the third area.

2. The envelope sheet according to claim 1, wherein the first adhesive pasted area is formed so that a length from the end of the third area to the first adhesive pasted area is equal to or greater than 20% of a width of the second area in the first direction.

3. The envelope sheet according to claim 2, wherein a length of the first area in the longitudinal direction is made equal to or greater than the length from the end of the third area to the first adhesive pasted area.

4. The envelope sheet according to claim 2, wherein an adhesive applied in each of the second adhesive pasted areas is stronger than an adhesive applied in the first adhesive pasted area.

5. The envelope sheet according to claim 2, further comprising a pair of oblique notches formed in the third area, the oblique notches being formed between the shortened portion and the second fold line.

6. The envelope sheet according to claim 1, wherein a length of the first area in the longitudinal direction is made equal to greater than a length from the end of the third area to the first adhesive pasted area.

7. The envelope sheet according to claim 1, further comprising a pair of oblique notches formed in the third area, the oblique notches being formed between the shortened portion and the second fold line.

8. An envelope sheet to be used in a stuff and seal apparatus, the envelope sheet comprising:

a rectangular first area provided with a flap at a first end thereof in a longitudinal direction;

a rectangular second area extended from the first area in the longitudinal direction and connected to the first area along a first fold line;

a third area extended from the second area in the longitudinal direction and connected to the second area along a second fold line, the second fold line being parallel to the first fold line;

a first adhesive pasted area formed on the third area to be adhered with the flap, the first adhesive pasted area extending in a direction that is parallel to the first fold line, and a pair of second adhesive pasted areas, each second adhesive pasted area extending in the longitudinal direction and formed in the first area, the second area and the third area, a pair of cutouts formed in the third area so as to form a shortened portion along an end of the third area, a width of the shortened portion being less than a width of the flap in a first direction orthogonal to the longitudinal direction, a width of the first adhesive pasted area is equal to or less than the width of the shortened portion in the first direction, and in a folded state, the third area is folded between the first and second areas, wherein an adhesive applied in each of the second adhesive pasted areas is stronger than an adhesive applied in the first adhesive pasted area.

* * * * *